US008328058B2

(12) United States Patent
Wilson

(10) Patent No.: US 8,328,058 B2
(45) Date of Patent: Dec. 11, 2012

(54) CONCEALMENT CADDY SHOULDER HOLSTER

(76) Inventor: Victor Allen Wilson, Arlington, TX (US)

( * ) Notice: Subject to any disclaimer, the term of this patent is extended or adjusted under 35 U.S.C. 154(b) by 0 days.

(21) Appl. No.: 13/385,139

(22) Filed: Feb. 4, 2012

(65) Prior Publication Data

US 2012/0152995 A1 Jun. 21, 2012

Related U.S. Application Data

(63) Continuation-in-part of application No. 12/658,247, filed on Feb. 5, 2010, now abandoned.

(51) Int. Cl.
*F41C 33/02* (2006.01)

(52) U.S. Cl. ..... 224/625; 224/674; 224/675; 224/680; 224/243; 224/911

(58) Field of Classification Search ..... 224/192, 224/193, 587, 600, 625, 626, 257, 258, 238, 224/911, 675, 674, 680, 243
See application file for complete search history.

(56) References Cited

U.S. PATENT DOCUMENTS

| | | | | |
|---|---|---|---|---|
| 5,234,145 | A * | 8/1993 | Padin | 224/243 |
| 5,294,031 | A * | 3/1994 | Volpei et al. | 224/682 |
| 5,358,159 | A * | 10/1994 | Lundie, Jr. | 224/624 |
| 5,692,237 | A * | 12/1997 | Bennett | 2/93 |
| 5,775,558 | A * | 7/1998 | Montalbano | 224/627 |
| 5,909,834 | A * | 6/1999 | Parrott, III | 224/587 |
| 6,131,198 | A * | 10/2000 | Westrick | 2/102 |
| 6,760,922 | B1 * | 7/2004 | Morales | 2/94 |
| 2004/0217141 | A1 * | 11/2004 | Brooks | 224/587 |
| 2007/0000965 | A1 * | 1/2007 | Cannon, Jr. | 224/673 |
| 2007/0250980 | A1 * | 11/2007 | Pellerin | 2/69 |
| 2009/0218379 | A1 * | 9/2009 | Harris et al. | 224/587 |

* cited by examiner

*Primary Examiner* — Justin Larson

(57) ABSTRACT

A universal type shoulder holster caddy, designed specifically to conceal hand guns of various sizes. This invention is unique in that it provides multiple transport options in a single handgun concealment device. It provides for complete concealment of a gun holster and handgun within an enclosed Concealment compartment. It provides multiple transport methods through its' zipper and snaps detachability feature and a series of loops and a band loop for attaching to a user's belt.

5 Claims, 11 Drawing Sheets

2
9
11
1
5
11
6
4

2
10
9
8
3
1
4

CONCEALMENT CADDY SHOULDER HOLSTER

This application is a continuation in part of prior application Ser. No. 12/658,247 filed Feb. 05, 2010, now abandoned.

CROSS-REFERENCE TO RELATED APPLICATIONS

"Not Applicable"

STATEMENT REGARDING. FEDERALLY SPONSORED RESEARCH OR DEVELOPMENT

"Not Applicable"

REFERENCE TO SEQUENCE LISTING, A TABLE, OR A COMPUTER PROGRAM LISTING COMPACT DISC APPENDIX

"Not Applicable"

BACKGROUND OF THE INVENTION

This invention generally relates to holsters for securing and carrying a handgun. The invention relates more specifically and particularly as a holster to provide for complete concealment of a handgun while providing easy access for the removal and re-engagement of a hand gun to a secure concealed position. This invention also provides versatility and ease of transport of a handgun due to its' multiple transport options.

While there currently exists various types of gun holsters on the market, most do not offer the advantage of complete concealment of the handgun without placing the holster itself under or inside of one's clothing. Many current methods of concealment present challenges for concealing and accessing the handgun. It is difficult to access a weapon which is concealed inside of or under ones' clothing while one is perhaps faced with an attack by an assailant. Additionally, it is often difficult to conceal a handgun and holster inside of ones' clothing without the imprint of the handgun being visible to the public.

Another problem presented by holsters currently available is the difficulty of using them with certain items of clothing, e.g. running apparel and/or light weight clothing typically worn in warm weather. There also exist the problems and difficulties of wearing holsters currently on the market securely while performing certain activities such as running and/or jogging. Typically activities, such as running or jogging, cause the holster to become highly mobile and swing back and forth or move rapidly up and down causing discomfort for the wearer and often allowing the handgun to disengage from the holster. Devices such as those known as "fanny packs" used for handgun concealment move rapidly up and down and are uncomfortable for the wearer during activities such as running and jogging.

Another disadvantage of most gun holsters currently available is that they typically allow a portion of the handgun to be exposed to the elements of the weather.

Although there may exist devices for handgun concealment. They may provide one or more of the features provided by the Concealment Caddy Shoulder Holster. There are none currently that provides all the features and flexibility of transport options provided by the Concealment Caddy Shoulder Holster as one single device. They do not provide for the complete concealment of the gun holster and the handgun.

Furthermore, devices typically used for complete concealment of a handgun are not built into a shoulder carry holster that consist of a shoulder harness that is detachable from the Concealment compartment that has a gun holster built inside; such Concealment compartment having belt loops for attaching to one's belt and a band loop for inserting a belt and attaching around the wearers abdomen as worn while running or jogging. Therefore, requiring the end user to use additional methods of transport such as a briefcase, backpack, purse, or requiring the user to occupy the device in one hand and not allowing for hands free portability. Devices currently available would require one to purchase multiple devices to provide for various methods of transport, e.g. a shoulder holster and a fanny pack.

BRIEF SUMMARY OF THE INVENTION

The Concealment Caddy Shoulder Holster accomplishes the objects and overcomes all prior stated difficulties and short comings in the following manner.

The Concealment Caddy Shoulder Holster has a built-in gun holding compartment design to hold securely handguns of various sizes and types, namely revolver or semi-automatics, within a specified range of sizes.

The secure compartment accomplishes the complete concealment of the handgun from public view, which is a requirement in states with conceal carry laws. The concealment compartment within a shoulder caddy eliminates the need to place the handgun and holster inside or under ones' clothing. This feature eliminates the bulk or handgun imprint often seen when concealing the handgun under or inside ones' clothing. The secure compartment further protects the handgun from elements of weather by completely covering the entire handgun.

Ease of access and re-engagement of the handgun is afforded through zipper access along the front facing portion of the shoulder caddy. Therefore, eliminating the need to open and/or remove items of clothing. The secure compartment with zipper access also prevents access by an unauthorized person.

Ease of transport of the handgun is accomplished by use of the shoulder carry feature. Therefore allowing ones' hands to remain free and eliminating the need for additional concealment devices or methods.

The concealment compartment further eliminates the need to wear a jacket, coat, or other items of clothing to conceal a holster. This feature further allows for ease of access to the handgun in threatening situations where one is under attack. The Concealment Caddy can be worn inside or outside of items of clothing.

The snap loop attached to the bottom of the caddy allows for attachment of the caddy to ones' belt while wearing trousers or shorts with a belt. The elastic band along the inner most side of the caddy creates a loop for inserting a belt to allow the user to secure the caddy to ones' body when wearing active wear clothing for running, jogging, and other activities, when a belt through pants loops are not typically worn. These features overcome the problem of having the handgun and holster move up and down or back and forth while the wearer is engaged in highly mobile activities. The ability to detach the concealment caddy from the shoulder allows additional options for the user to transport the caddy. This feature is accomplished via a zipper and snaps along the top section of the concealment caddy and along the bottom section of the shoulder harness. The concealment caddy can be attached to the belt of a user to provide additional transport options for a user wearing a belt with trousers or shorts. This option is accomplished by placing a belt through the belt loops attached to the inner most side of the concealment caddy.

DETAILED DESCRIPTION OF THE INVENTION

Now referencing specifically the drawings to aid in describing the present invention:

It is quite possible to construct or manufacture this invention using a variety of materials and methods. The invention is also susceptible to various modifications. The drawings depicting the invention and these subsequent detailed descriptions of the drawings are not intended to place limitations on the claims of the inventor. These drawings and their description are in no way intended to limit the invention to the specific form as disclosed. This invention is, however, intended to cover all modifications, methods, and alternative constructions and any subsequent equivalents within the spirit of the invention as described and claimed.

Figure 1:
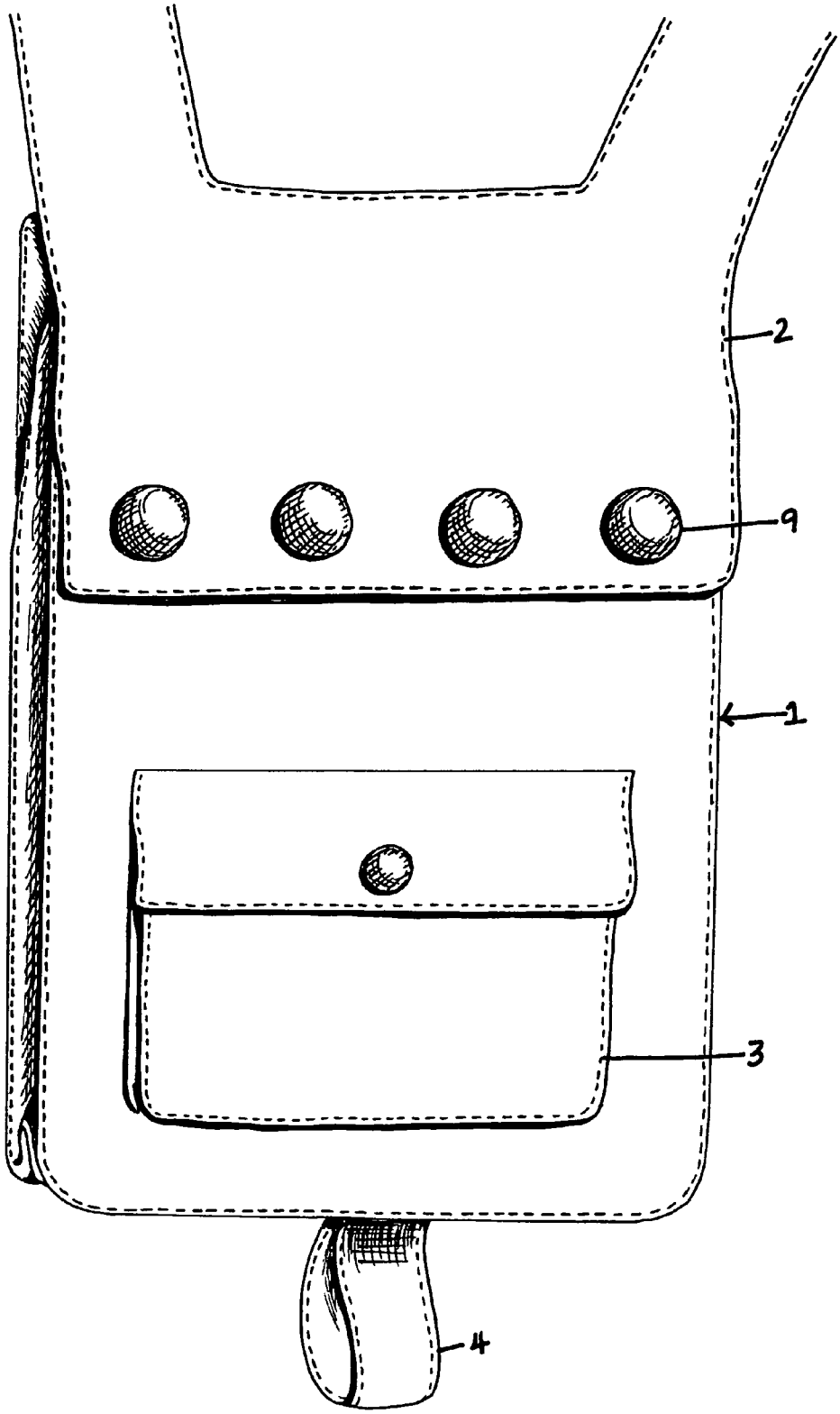
FIG. 1 is a side view of the Concealment Caddy Shoulder Holster showing the outer most side of the caddy and the accessory pocket, and the snaps for connecting the shoulder harness.
Figure 2:
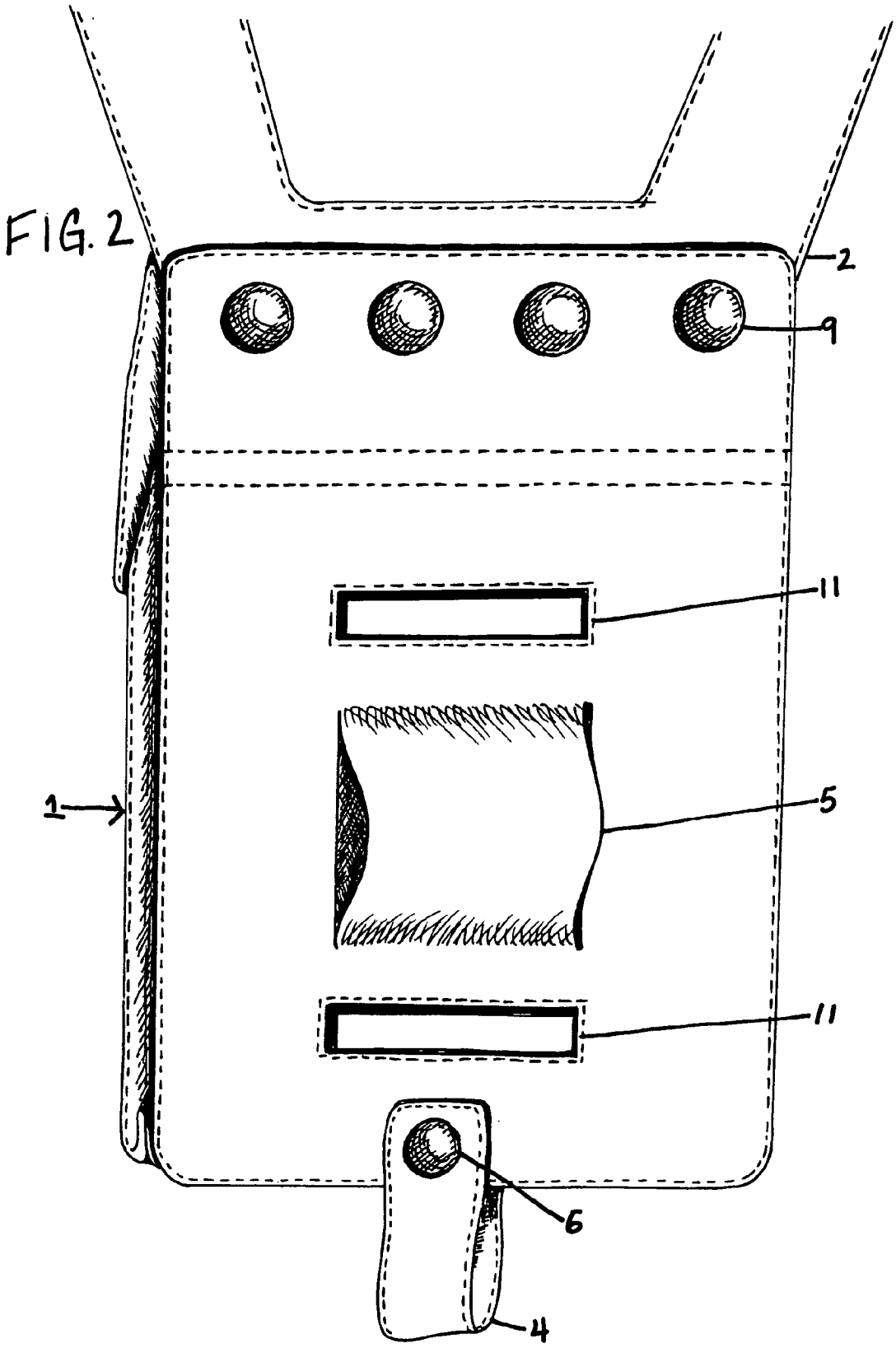
FIG. 2 is a side view of the Concealment Caddy Shoulder Holster showing the inner most side of the caddy, the elastic band loop, the belt loops, and the snaps to attach the caddy to the shoulder harness.
Figure 5:
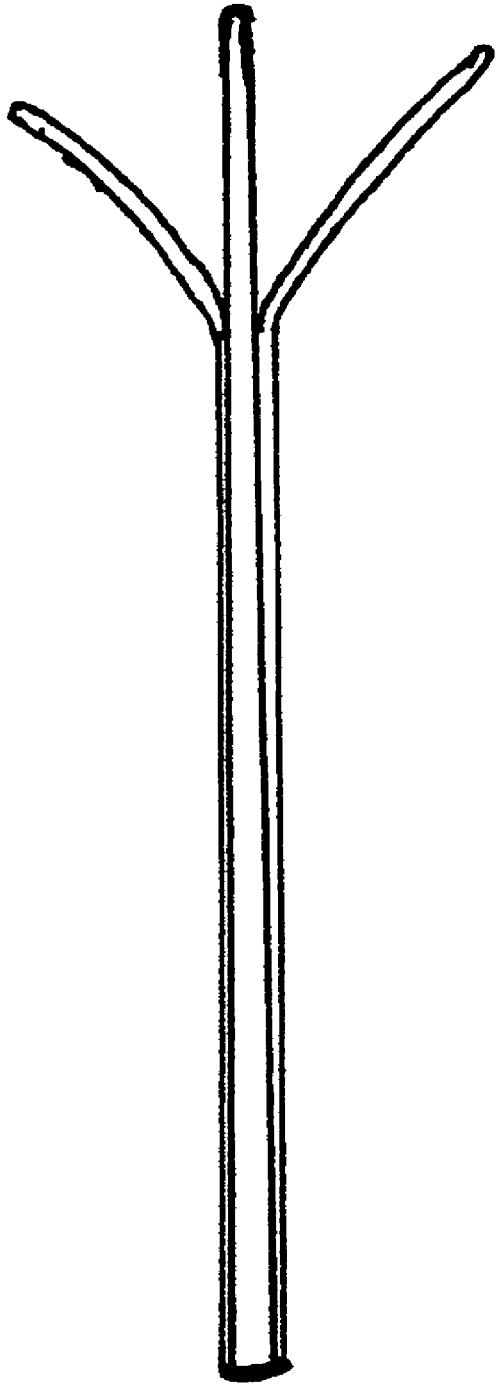
FIG. 5 is a profile view of one of the side panels showing the 3 layered construction.

The caddy (1) and the shoulder harness (2), is to be constructed of a light weight durable material. The caddys' (1) outer walls and shoulder harness (2), seen in FIG. 1 & FIG. 2, are to be constructed of a lightweight solid material to provide for complete concealment of the handgun. The preferred material for manufacture is polyurethane or neoprene with a covering of heavy duty nylon for durability and protection from weather. The layered construction of these panels shall consist of using a heavy duty adhesive to attach the nylon to each side of polyurethane or neoprene panels and sewing the three layers together as depicted in FIG. 5. Though it is not intended to limit construction of the outside panels specifically to polyurethane or neoprene and nylon, the intent is to also allow for the outer panels to be constructed of any number of a variety of materials that are durable enough to provide for extended and regular use of the invention, yet flexible and light weight enough to provide for practical use of the invention, e.g. it is also desired, in certain instances, to use such materials as heavy duty leather, raw hide and/or other synthetic materials for the construction of outside panels of the present invention. This would allow the manufacture to provide a variety of color and style choices for the end user.

Figure 4:
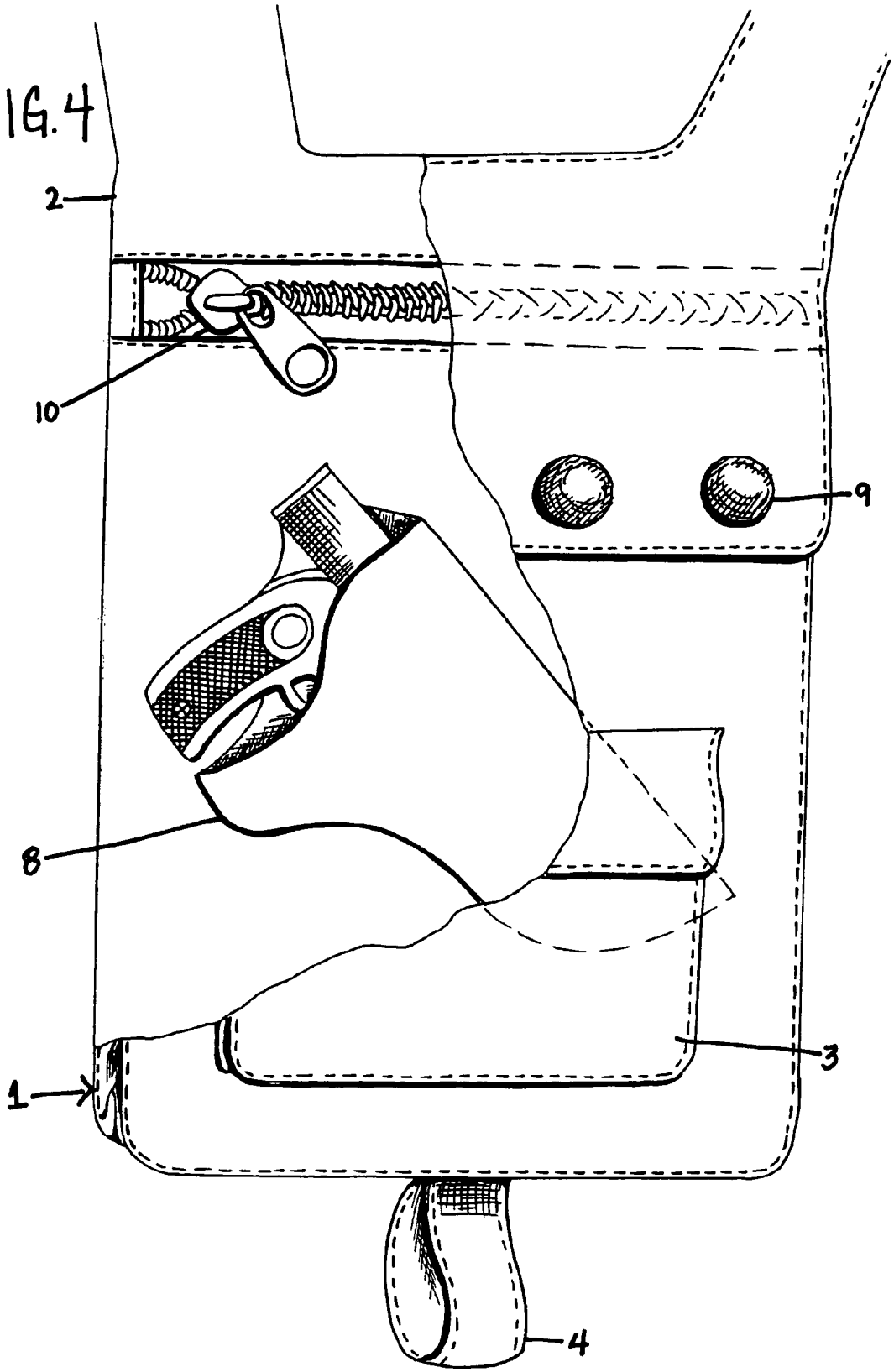
FIG. 4 is an inside view of the inner most side showing the gun holster attached within and the zipper and snaps used to attach to the shoulder harness.
Figure 6:
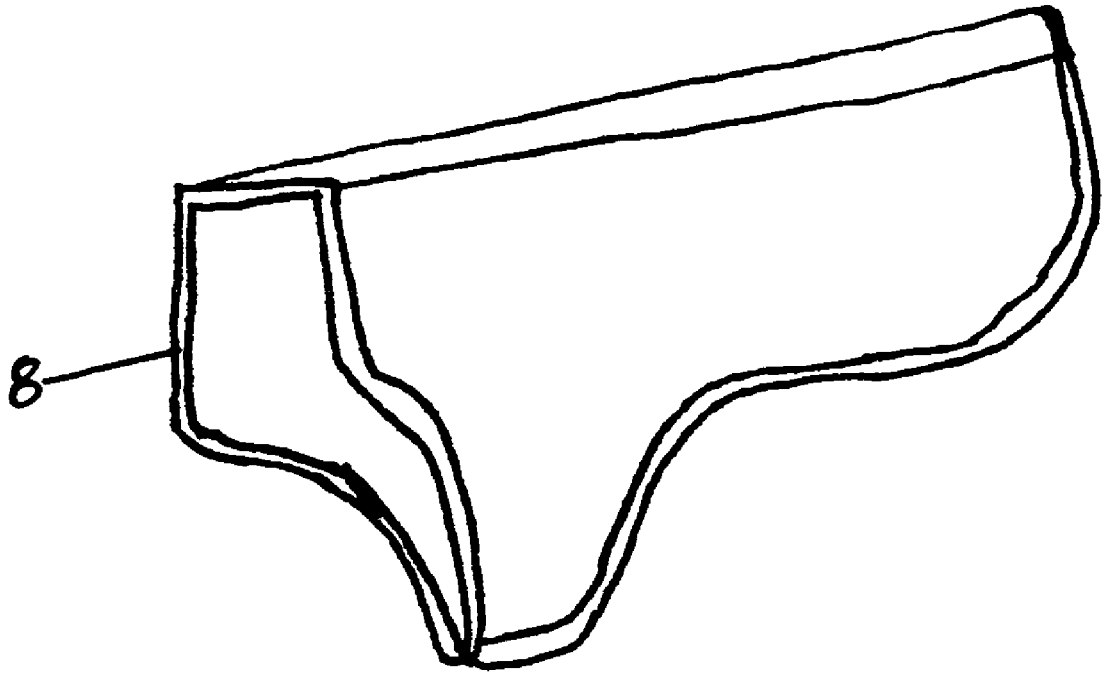
FIG. 6 is a view of the gun pocket detached from the inside of the Caddy.

The gun holder (8) portion of the present invention FIG. 4 and FIG. 6 is to be constructed of a heavy duty elastomer to provide for flexibility to allow various size and types of handguns to be easily inserted and removed from the holster. The elastomer in the present invention is to be lined with a soft durable fabric such as nylon or a similar material to increase durability and reduce friction on the handgun to further allow for ease of engaging and disengaging from the holster. The fabric lining should be attached to the holster using a heavy duty adhesive and the three linings sewn together.

The gun holder (8) FIG. 4 and FIG. 6 should be sewn to the inside panel of the caddy and orientated on a downward facing angle FIG. 4 to allow the handgun when engaged to point slightly downward for added security and further reduction of the possibility of unintended disengagement.

Figure 3:
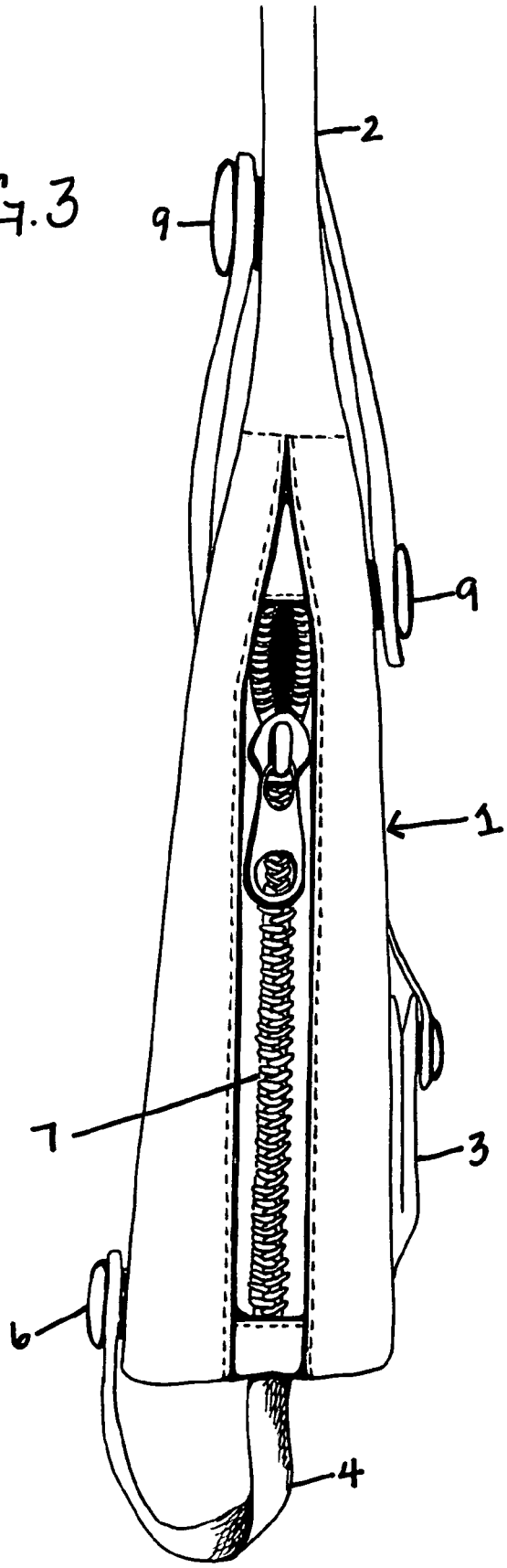
FIG. 3 is a frontal view of the Concealment Caddy Shoulder Holster attached to the shoulder harness showing the zipper for accessing the handgun compartment sewn into a heavy fabric for attaching the two sides.

The zipper (7) shown FIG. 3 shall be a heavy duty zipper in a heavy fabric such as a durable heavy nylon and sewn to the side panels of the Caddy (1), the same type heavy fabric shall be used to attach the back side of the two panels without the zipper (7) sewn in.

Though the drawings in FIG. 2 and FIG. 3 depict a Concealment Caddy (1), shoulder harness (2), and holster to be used by a right handed user, it is not intended to limit the present invention to a patent specifically for right hand use. But, to the contrary, it is the intention of the inventor to be awarded a patent by the U. S. Patent and Trademark Office that allows for the protection of and construction of said patent in a form for the use by left handed and/or right handed users.

FIG. 1 represents an outside outward facing view of the outer most side of the caddy (1) and shoulder harness (2), showing a storage pocket (3) with snap fastener for storing cell phones, extra magazines, etc. for further concealment of handgun compartment.

The accessory pocket (3) FIG. 1 on the outside of the outer panel of the caddy (1) shall be constructed of durable nylon and sewn to the outside of the outside panel when the panel is constructed using nylon as the outside liner. The pocket (3) shall be constructed of leather, raw hide or other material consistent with the material used to construct the outside panels when the panels are constructed of such materials.

FIG. 2 depicts the elastic loop (5) attached to the lower portion of the inner most side of the inside panel to allow the end user to insert a belt to secure the caddy (1) to the abdomen during activities, such as running or jogging or as the end user deems necessary; FIG. 2 further reveals the belt loops (11) designed for inserting the belt of a user while wearing trousers or shorts with a belt.

The lower strap (4) FIG. 1, FIG. 2, FIG. 3, and FIG. 4 with snap locking mechanism should allow the end user to attach the lower portion of the caddy (1) by looping the strap (4) around a belt worn by the end user. The strap (4) shall be sewn to the bottom of the inside panel during manufacture. The stud (6) portion of the strap attachment will be attached to the outside of the inside panel positioned sufficiently to allow attachment of the end of the strap (4) using the socket portion of the snap (6) attached to the end of the strap (4).

Figure 7:
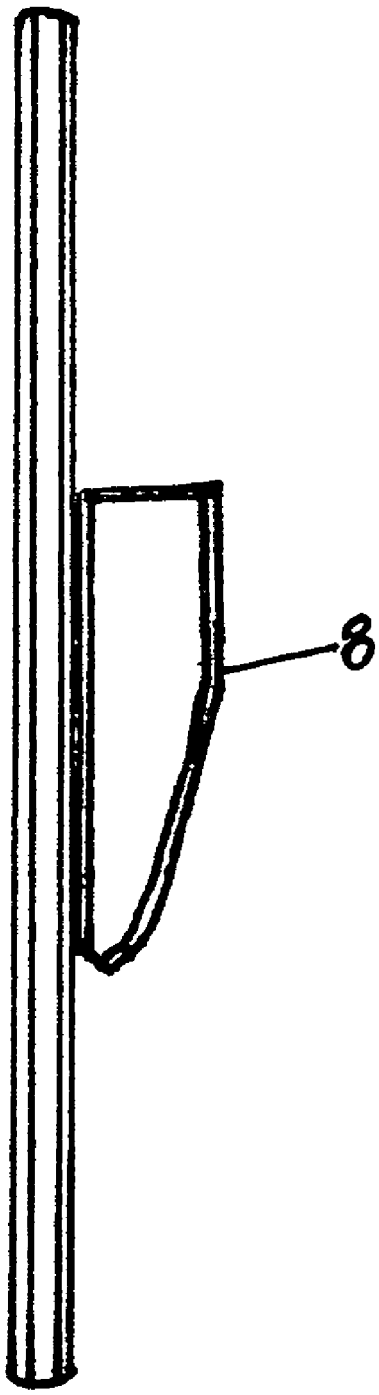
FIG. 7 is a profile view of one of the side panels with the gun holster attached.

FIG. 7 depicts the gun holster (8) attached to the inside of the inner most side panel of the caddy (1). The gun holster (8) is attached with a heavy duty adhesive and subsequently sewn to the panel.

Figure 8:
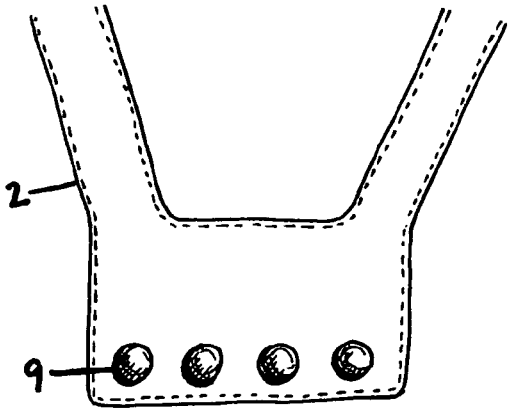
FIG. 8 is a side view of the lower portion of the shoulder harness.

FIG. 8 depicts the lower section of the shoulder harness (2) and revealing the outside of the snaps (9) used for attaching the shoulder harness (2) to the concealment caddy (1).

Figure 9:
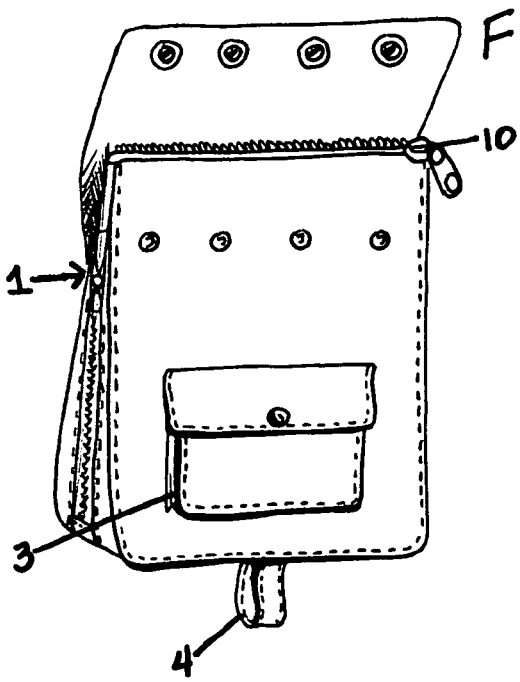
FIG. 9 is a side view of the Concealment Caddy detached from the shoulder harness.

FIG. 9 depicts the concealment caddy (1) detached from the shoulder harness (2) and revealing the lower half of the zipper (10) and the inside view of the snaps (9) used to attach and detach the caddy (1) to and from the shoulder harness (2).

Figure 10:
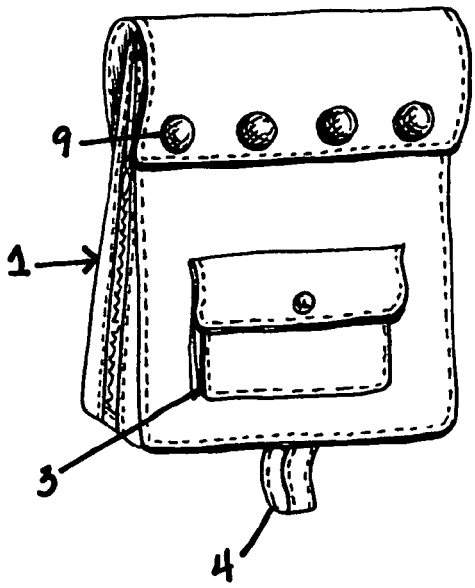
FIG. 10 is a side view of the shoulder caddy detached from the shoulder harness with attachment snaps closed over the zipper.

FIG. 10 depicts the concealment caddy (1) detached from the shoulder harness (2) with the snaps (9) closed and snapped onto the concealment caddy (1).

Figure 11:
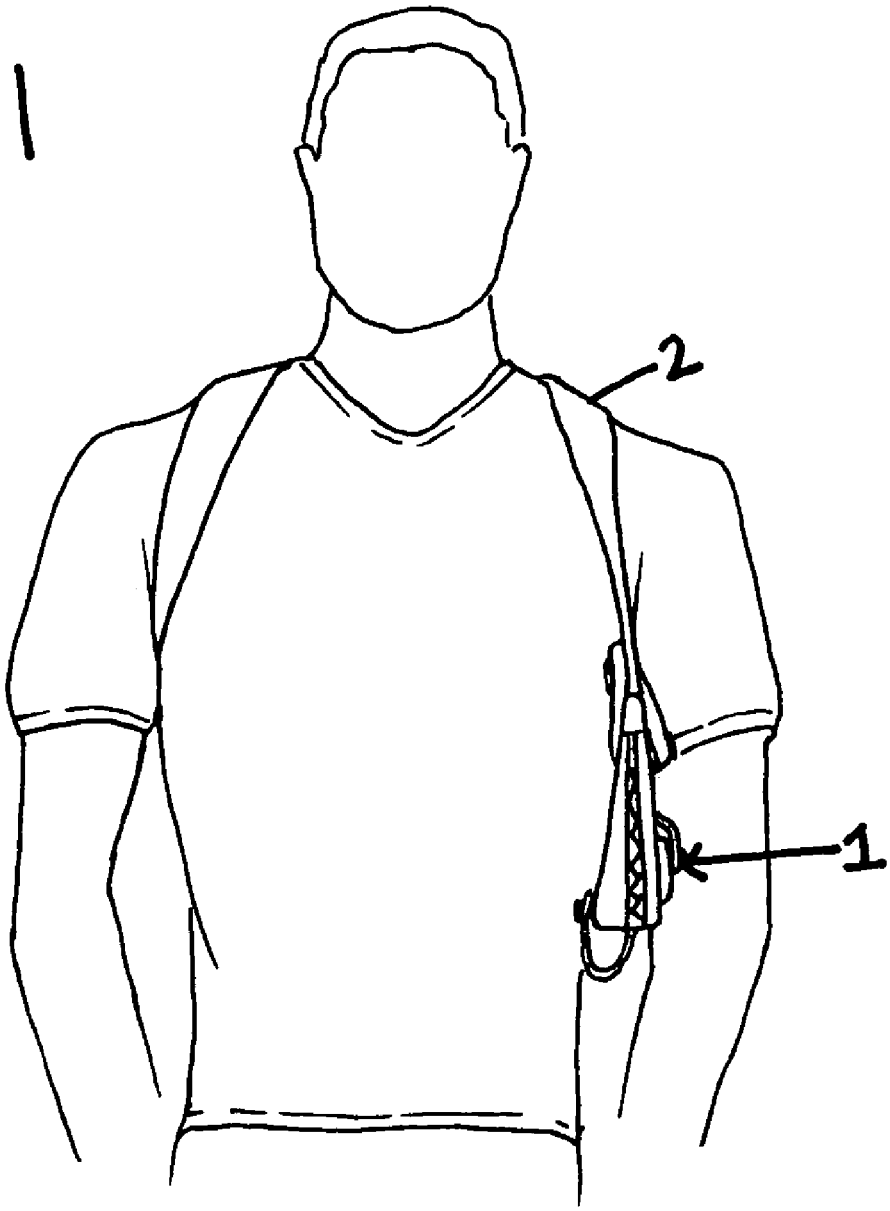
FIG. 11 is a frontal view of the Concealment Caddy attached to the shoulder harness worn by a user.

FIG. 11 is a frontal view of the shoulder harness (2) attached to the concealment caddy (1) as worn by a user.

Figure 12:
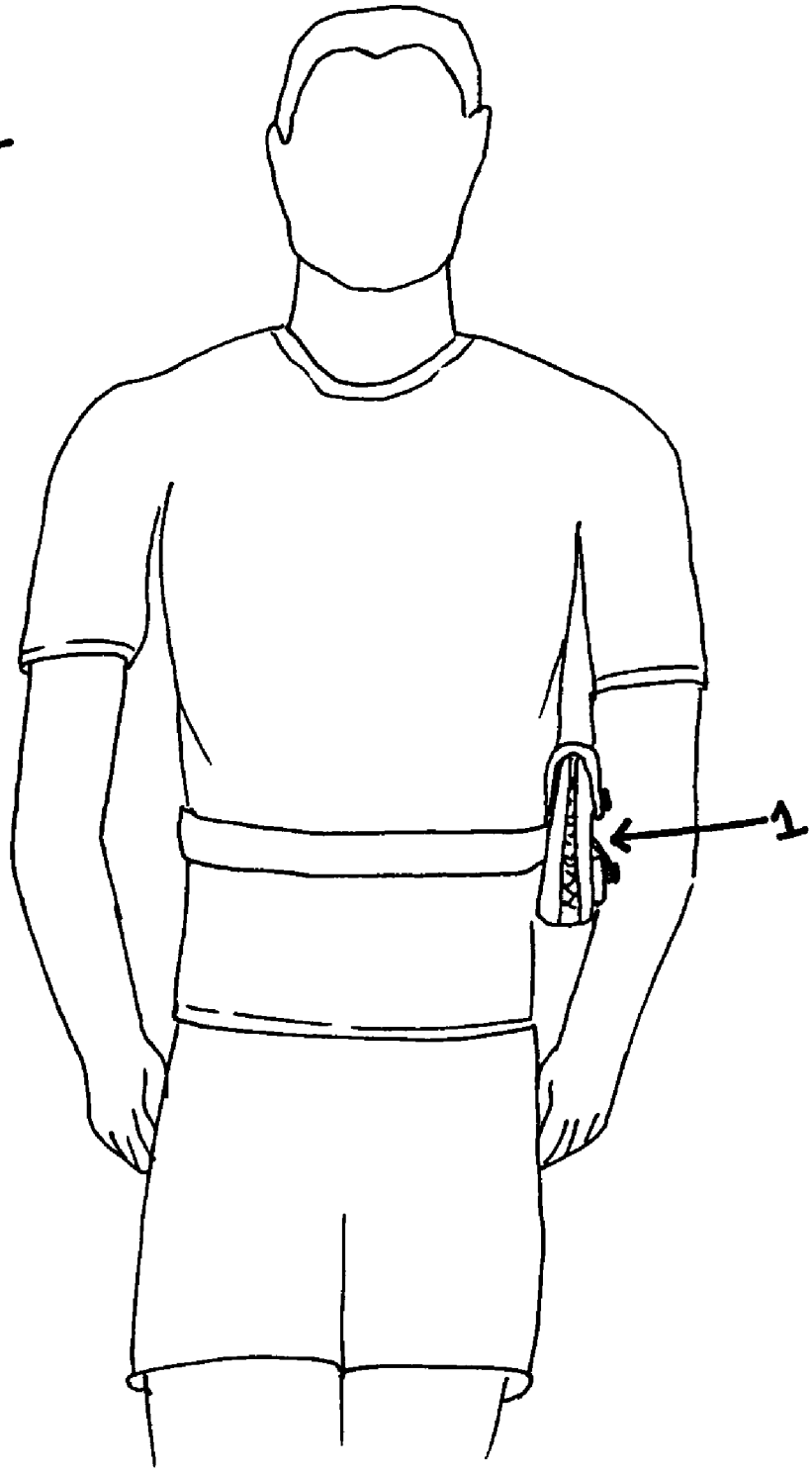
FIG. 12 is a frontal view of the Concealment Caddy detached from the shoulder harness as worn by a user in running attire.

FIG. 12 is a frontal view of the concealment caddy (1) detached from the shoulder harness (2) depicted with a belt inserted through the band loop (5) as worn around the abdomen of a user.

Figure 13:
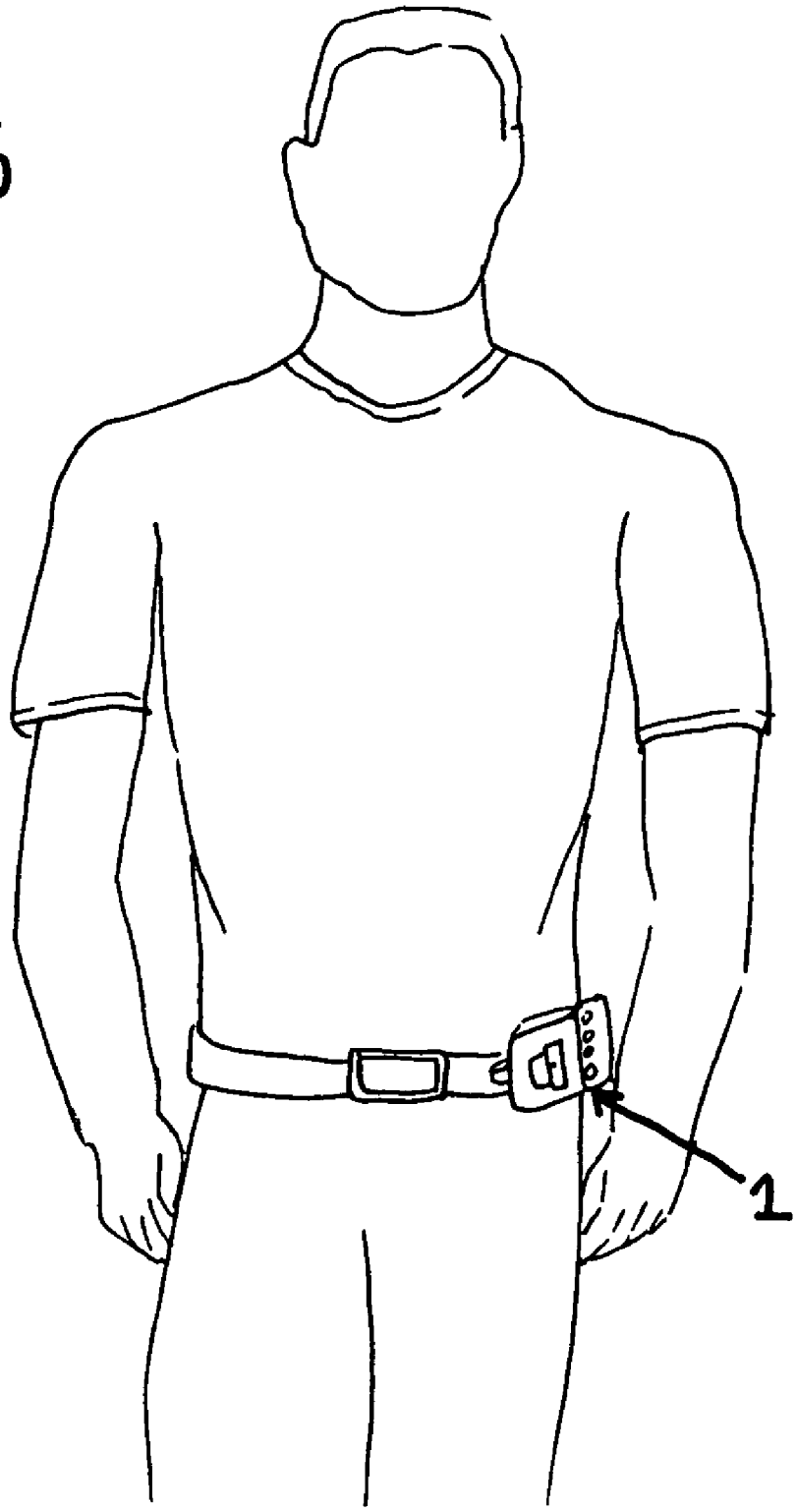
FIG. 13 is a frontal view of the Concealment Caddy detached from the shoulder harness and attached to the belt of a user.

FIG. 13 is a frontal view of the concealment caddy (1) detached from the shoulder harness (2) shown worn horizontally attached to a users belt via the attached belt loops (11).

I claim:

1. A concealment caddy shoulder holster, comprising:

a shoulder harness;

a concealment compartment including a first belt attachment along a bottom of the compartment that allows a user to carry the compartment on their belt in a first orientation and at least one second belt attachment along an inner side of the compartment that allows a user to carry the compartment on their belt in at least one second orientation;

and a gun holster secured to and completely concealed within the concealment compartment;

wherein the concealment compartment is removably connected to a lower end of the shoulder harness via a zipper and at least one flap with snap fasteners;

and wherein when the concealment compartment is removed from the shoulder harness, the at least one flap can be folded over and secured in place so as to conceal the exposed zipper on one of the shoulder harness and the concealment compartment.

2. The concealment caddy shoulder holster according to claim 1, wherein the first belt attachment is a strap that forms a releasable loop through which a user's belt can be fed.

3. The concealment caddy shoulder holster according to claim 1, wherein the at least one second belt attachment includes a pair of vertically oriented belt loops and a single horizontally oriented belt loop so that a user can wear the concealment caddy in different orientations.

4. The concealment caddy shoulder holster according to claim 1, further comprising a zipper along a front side of the concealment compartment that provides access to the gun holster.

5. The concealment caddy shoulder holster according to claim 1, further comprising an accessory pocket attached to an outer side of the concealment compartment.

* * * * *